US005410938A

United States Patent [19]

Kurosaki et al.

[11] Patent Number: 5,410,938

[45] Date of Patent: May 2, 1995

[54] DRUM EMPLOYING A DOUBLE TYPE SCREW UNIT FOR DRUM HEAD TENSION

[75] Inventors: Makoto Kurosaki; Mitsumasa Gotoh, both of Hamamatsu, Japan

[73] Assignee: Yamaha Corporation, Shizuoka, Japan

[21] Appl. No.: 268,194

[22] Filed: Jun. 29, 1994

Related U.S. Application Data

[63] Continuation of Ser. No. 25,178, Mar. 2, 1993, abandoned.

[30] Foreign Application Priority Data

| | | | |
|---|---|---|---|
| Mar. 3, 1992 | [JP] | Japan | 4-081547 |
| Mar. 3, 1992 | [JP] | Japan | 4-081548 |
| Apr. 22, 1992 | [JP] | Japan | 4-129441 |
| Apr. 22, 1992 | [JP] | Japan | 4-129442 |

[51] Int. Cl.[6] ..... G10D 13/02

[52] U.S. Cl. ..... 84/411 R; 84/413

[58] Field of Search ..... 84/411 R, 412, 413, 84/419, 411 A

[56] References Cited

U.S. PATENT DOCUMENTS

| | | | |
|---|---|---|---|
| 4,619,179 | 10/1986 | Wright | 84/413 |
| 4,833,964 | 5/1989 | Prouty | 84/411 R |
| 4,869,146 | 9/1989 | Bonsor | 84/413 |

FOREIGN PATENT DOCUMENTS 62-038710 8/1987 Japan .

*Primary Examiner*—Michael L. Gellner
*Assistant Examiner*—Cassandra Spyrou
*Attorney, Agent, or Firm*—Ostrolenk, Faber, Gerb & Soffen

[57] ABSTRACT

In construction of a drum having at least one drum head, the drum head is set in tension, by assistance of a fastening counterhoop, to a suspension ring fixed to one open end of a tubular kettle and a double-type screw unit used for manual fastening of the drum head includes lug nuts mounted to the suspension ring preferably via idle, tiltable engagement and cooperative fastener bolts mounted to the counterhoop in screw engagement with the lug nuts on the suspension ring. Automatic centering is performed by the screw unit during fastening thanks to the idle, tiltable engagement and such automatic centering by the screw unit enables high tension fastening of the drum head without causing any breakages in the screw construction.

4 Claims, 3 Drawing Sheets

DRUM EMPLOYING A DOUBLE TYPE SCREW UNIT FOR DRUM HEAD TENSION

This is a continuation of application Ser. No. 08/025,178, filed on Mar. 2, 1993, now abandoned.

BACKGROUND OF THE INVENTION

The present invention relates to a drum, and more particularly relates to improvements in fastening mechanism of a drum provided with a screw unit used for fastening of its drum heads.

One example of a drum provided with such a screw unit for drum head fastening is disclosed in U.S. Pat. No. 4,869,146. The drum of this earlier application is provided with a single-type screw unit for fastening upper and lower (top and bottom) drum heads concurrently. More specifically, the first counterhoop is attached to one open end of a tubular kettle (drum shell) via an intermediate hoop. Whereas, the second counterhoop is attached directly to another open end of the kettle. The screw unit includes fastener bolts each of which extends past the second counterhoop towards the first counterhoop for screw engagement with the intermediate hoop. In operation, the fastener bolts are turned manually in order to fasten the upper and lower drum head concurrently.

During this drum head fastening, reaction forces generated thereby act on the kettle in a manner to compress the kettle in the axial direction. That is, the reaction forces generated in the screw unit by drum head fastening are borne by the intermediate hoop on the upper side and by the second counterhoop on the lower side. Since the intermediate hoop is attached directly to one open end of the kettle, the reaction force borne by the intermediate hoop acts on the kettle downwards. Whereas, since the second counterhoop is attached to another open end of the kettle, the reaction force born by the second counterhoop acts on the kettle upwards. As a consequence, the kettle is compressed in the axial direction.

In order to provide the drum head with high tension, strong fastening must be carried out by the screw unit and stronger fastening inevitably causes higher compression on the kettle. Such high compression on the kettle wields malign influence on vibratory behaviour of the kettle at tone generation, thereby seriously impairing acoustic characteristics of the drum.

In addition, since the screw unit has a single-type construction, it allows concurrent fastening of the two drum heads only. This mono-functional feature of the screw unit forms a problem when independently controlled fastening of different drum heads is required.

Further, one end of the fastener bolt is fixedly received in the second counterhoop whilst allowing no tilting of the fastener bolt. It is very difficult in practice to position all the fastener bolts in strict alignment with associated screw holes in the intermediate hoop. When fastening is carried out with some of the fastener bolts being out of strict alignment with the associated screw holes, forced screw engagement tends to seriously damage the screw unit.

Another example of a drum with a screw unit for drum head fastening is disclosed in JPP (Japanese Patent Publication) Sho. 62-38710 in which, briefly speaking, the construction of U.S. Pat. No. 4,869,146 is reversed upside down. The drum of this earlier application includes a double-type screw unit for fastening upper and lower (top and bottom) drum heads independently. More specifically, the first counterhoop is attached directly to one open end of a tubular kettle, the second counterhoop is attached directly to another open end of the kettle, and first and second suspension rings are attached to the body of the kettle at positions between the first and second counterhoops.

A screw unit includes first group of fastener bolts each of which extends past the first counterhoop towards the second counterhoop for screw engagement with the first suspension ring. The screw unit further includes second group of fastener bolts each of which extends past the second counterhoop towards the first counterhoop for screw engagement with the second suspension ring.

In operation, the fastener bolts of the first group are turned manually for fastening of the upper drum head whereas the fastener bolt of the second group are turned manually for fastening of the lower drum head. Thus the double-type screw unit of this earlier application enables independent fastening control on different drum heads. Despite this merit, the drum is still accompanied with the problems of kettle compression and bolt-screw alignment.

When the upper drum head is fastened for example, reaction forces generated thereby act on the kettle in a manner to compress the kettle in the axial direction. That is, the reaction forces generated in the screw unit by drum head fastening are borne by the first counterhoop on the upper side and by the first suspension ring on the lower side. Since the first counterhoop is attached directly to one open end of the kettle, the reaction force borne by the first counterhoop acts on the kettle downwards. Whereas, since the first suspension ring is attached directly to the body of the kettle, the reaction force borne by the first suspension ring acts on the kettle upwards. As a consequence, the kettle is compressed in the axial direction just as in the case of U.S. Pat. No. 4,869,146.

In addition, one end of the fastener bolt is fixedly received in an associated counterhoop whilst allowing no tilting of the fastener bolt. Thus, damage of the screw unit is apt to result when its screw engagement is out of strict alignment.

Lowering in acoustic characteristic is further amplified by direct attachment of additional components, i.e. the first and second suspension rings, to the body of the kettle.

SUMMARY OF THE INVENTION

It is thus the primary object of the present invention to provide a drum of a high tension drum head with reduced breakage of its screw unit used for fastening the drum head and no degradation of the acoustic characteristics.

In accordance with the basic concept of the present invention, a drum head is set in tension, by assistance of a fastening counterhoop, to a suspension ring fixed to one open end of a tubular kettle and a double-type screw unit used for manual fastening of the drum head includes lug nuts mounted to the suspension ring and cooperative fastener bolts mounted to the counterhoop in screw engagement with the lug nuts on the suspension ring.

DESCRIPTION OF THE PREFERRED EMBODIMENTS

Figure 1:
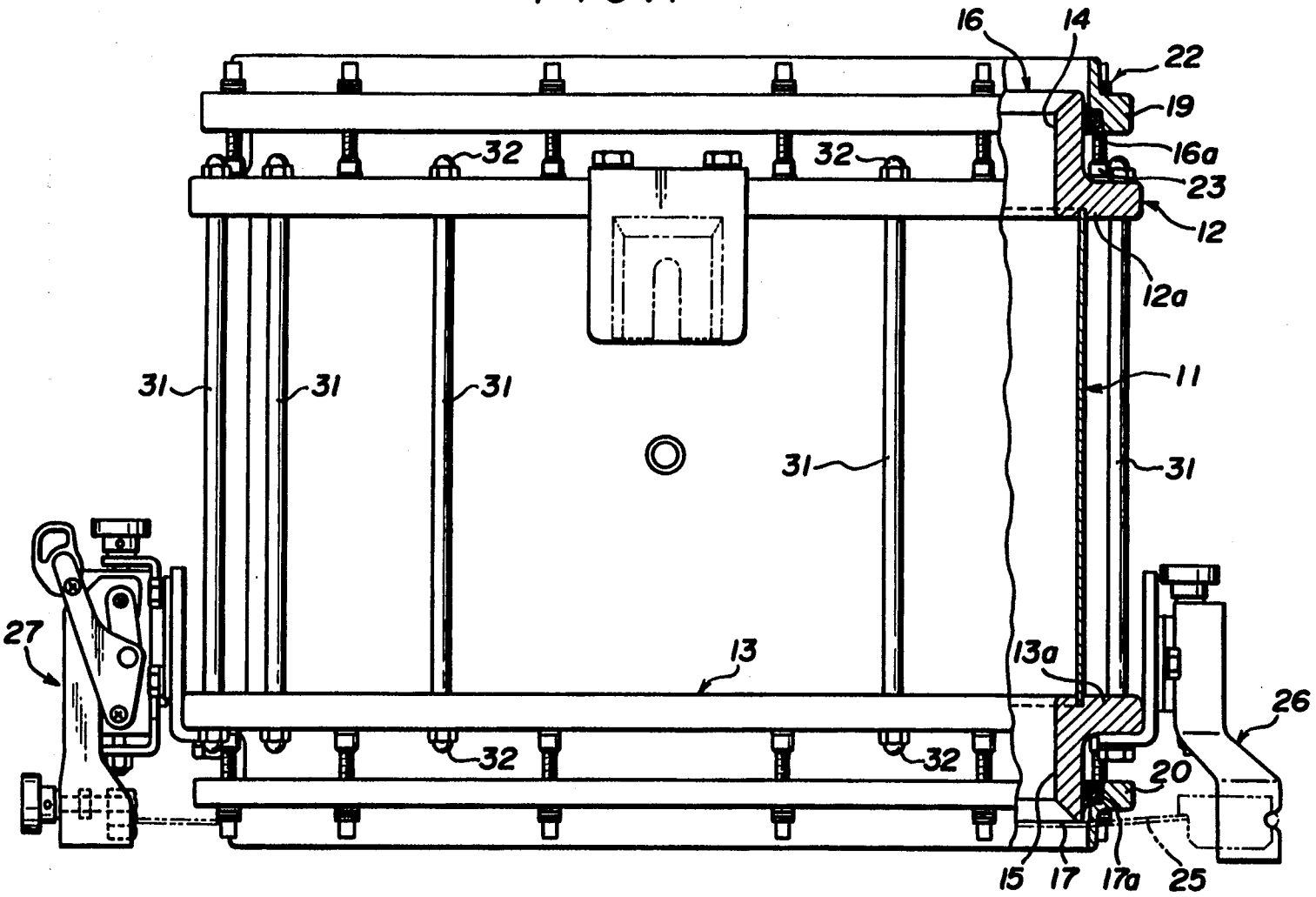
FIG. 1 is a side view, partly in section, of one embodiment of the drum in accordance with the present invention.

The entire construction of the first embodiment of the drum in accordance with the present invention is shown in FIG. 1. In the shown construction, the drum includes a tubular kettle 11 open at both longitudinal ends and a pair of suspension rings 12 and 13 fixedly inserted over both open ends of the kettle 11. The suspension rings 12 and 13 are each made up of a tubular section and projections 12*a* and 13*a* formed at one end of the tubular section and the tubular sections of the suspension rings 12 and 13 define circular openings 14 and 15. In the case of the illustrated position, the first suspension ring 12 defines an upper opening 14 near the upper open end of the kettle 11 whereas the second suspension ring 13 defines a lower opening 15 near the lower open end of the kettle 11.

Figure 2:
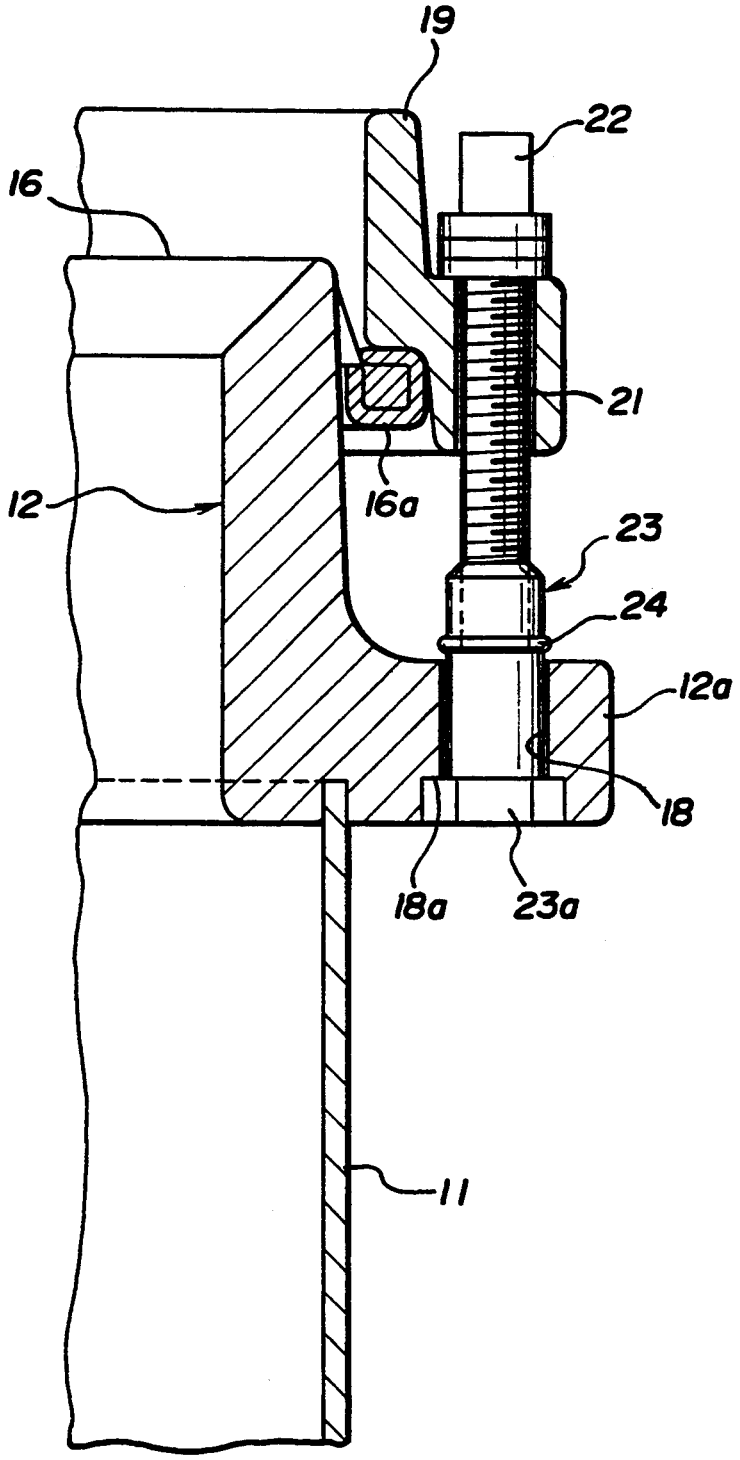
FIG. 2 is a sectional side view of one embodiment of the screw unit used for the drum shown in FIG. 1.

The projections 12*a* and 13*a* project radially outwards of the distal ends of the suspension rings 12 and 13 beyond the outer surface of the kettle-11. The projections 12*a* and 13*a* are spaced from each other in the axial direction of the kettle 11 by a distance equal to the axial length of the kettle 11. The projections 12*a* and 13*a* are further located at an equal angular position about the axis of the kettle 11. A plurality of through holes 18 are formed in the projections 12*a* and 13*a* at equal intervals along the circumferential direction whilst extending in the axial direction of the kettle 11 as best seen in FIG. 2. The through hole 18 is circular in cross sectional profile and provided, at its end near the kettle 11, with a circular step 18*a*.

The inner surface of each suspension ring 12 or 13 slightly diverges toward the kettle 11 and the openings 14 and 15 are closed by drum heads 16 and 17, respectively. The drum heads 16 and 17 are set in tension by counterhoops 19 and 20. More specifically, annular brims 16*a* and 17*a* of the drum heads 16 and 17 are pressed inwards against the projections 12*a* and 13*a* of the suspension rings 12 and 13 by the counterhoops 19 and 20, respectively. Thus, the inner surfaces of the counterhoops 19 and 20 are kept in pressure contact with the annular brims 16*a* and 17*a* of the drum heads 16 and 17. Through holes 21 are formed in the counterhoops 19 and 20 at positions and with numbers corresponding to those of the through holes 18 formed in the suspension rings 12 and 13.

A double-type screw unit is used for pressing the counterhoops 19 and 20 against the projections 12*a* and 13*a* of the suspension rings 12 and 13. The screw unit includes several sets of fastener bolts 22 and cooperative lug nuts 23 received in the through holes 18 and 21. More specifically, the lug nut 23 is received in the through hole 18 in the suspension ring 12 (see FIG. 2) with its end flange 23*a* resting in the circular step 18*a* of the through hole 18. A stop ring 24 is attached to the lug nut 23 so as to fix its axial position in the through hole 18 in cooperation with the end flange 23*a* in the circular step 18*a*. However, the lug nut 23 is designed somewhat smaller in diameter than the associated through hole 18 so that the lug nut 23 can be idly received in the through hole 18. This idle holding in the through hole 18 allows the lug nut 23 to tilt somewhat in the through hole 18. The degree of this idle, tiltable engagement is designed such that the axial direction of the lug nut 23 can be biased over a prescribed angle with respect to the axial direction of the through hole 18.

In order to allow such controlled tilting of the lug nut 23, the contact surface of the end flange 23*a* of the lug nut 23 may be shaped somewhat convex with respect to a flat construction of the circular step 18*a*.

The fastener bolt 22 extends through the through hole 21 in the counterhoop 19 for screw engagement at its distal end with an associated lug nut 23 on the suspension ring 12. By manually turning the fastener bolt 22 into deeper screw engagement with the lug nut 23, the annular brim 16*a* of the drum head 16 is tightly pressed against the suspension ring 12 as best seen in FIG. 2.

The lower (bottom side) drum head 17 is accompanied with snappy cords 25 which extends in transverse contact with the drum head 17. Snare trainers 26 and 27 are mounted to the projections 13*a* of the lower suspension ring 13 in order to hold the snappy cords 25 in tension.

The upper and lower suspension rings 12 and 13 are connected to each other by a number of connector rods 31 extending in the axial direction of the kettle 11.. Both ends of the connector rod 31 are fixed to the projections 12*a* and 13*a* of the suspension rings 12 and 13 by set screws 32. The number of connector rods 31 are arranged at equal intervals around the kettle 11. The connector rods 31 are given in any form such as shafts, pipes and spokes as long as they are rigid enough for reliably connecting the two suspension rings 12 and 13. For reduction in weight of the entire drum, whilst assuring a necessary rigidity, carbon fibers and titanium are preferable used for the connector rods 31.

With the above-described construction, the drum in accordance with the present invention operates as follows.

First, for setting of the drum heads 16 and 17 to the suspension rings 12 and 13 connected to each other by the connector rods 31, each fastener bolt 22 is screwed into an associated lug nut 23 so that the counterhoops 19 and 20 press the annular brims 16*a* and 17*a* of the drum heads 16 and 17 against the projections 12*a* and 13*a* of the suspension rings 12 and 13, respectively. To this end, the point of the fastener bolt 22 is brought into initial screw engagement with the lug nut 23 past the through hole 21 in the counterhoop 19 or 20. At this stage of the operation, the fastener bolt 22 and the lug nut 23 may be out of strict alignment with each other. As the fastener bolt 22 is further turned manually, the fastener bolt 22 and the lug nut 23 are gradually brought into strict alignment due to the tiltable engagement of the lug nut 23 with the through hole 18 in the suspension ring 12 or 13.

In other words, automatic centering between the fastener bolt 22 and the lug nut 23 is carried out during the subsequent turning of the bolt 22. Thanks to such automatic centering, no excessive force acts on the threaded sections of the fastener bolt 22 and the lug nut 23. Thus, undesirable breakage of the screw unit can be effectively evaded. In addition, the automatic centering well avoids variation in fastening force between different bolt-nut combinations. As a result, uniform fastening can be carried over circumference of the drum thereby eliminating undesirable stress concentration on structurally weak points of the suspension ring.

The crown of each fastener bolt 22 is exposed out of the counterhoop 19 or 20 in the axial direction of the kettle 11 and such arrangement does not hinder manual turning of the fastener bolt 22 at all. No metallic components are directly attached to the kettle 11 itself and this arrangement assures good vibration of the kettle 11 at tone generation.

Connection between the upper and lower suspension rings 12 and 13 via the rigid connector rods 31 allows strong fastening by the screw unit which assures high tension on the drum heads 16 and 17. When high tension on the drum heads 16 and 17 is wanted without increase in weight of the entire drum, it is advisable to reduce the number of the connector rods 31. In this case, however, it is preferable to use spoke-type connector rods made of aluminium in order to preserve stable connection between the upper and lower suspension rings 16 and 17.

For better acoustic characteristics of the drum, suspension rings made of a light and highly rigid material such as carbon fibers, aluminium or titanium is advantageously combined with a kettle made of carbon fibers, maple trees, birch trees or cypress. Only one open end of the kettle 11 may be closed by a drum head via a suspension ring.

Figure 3:
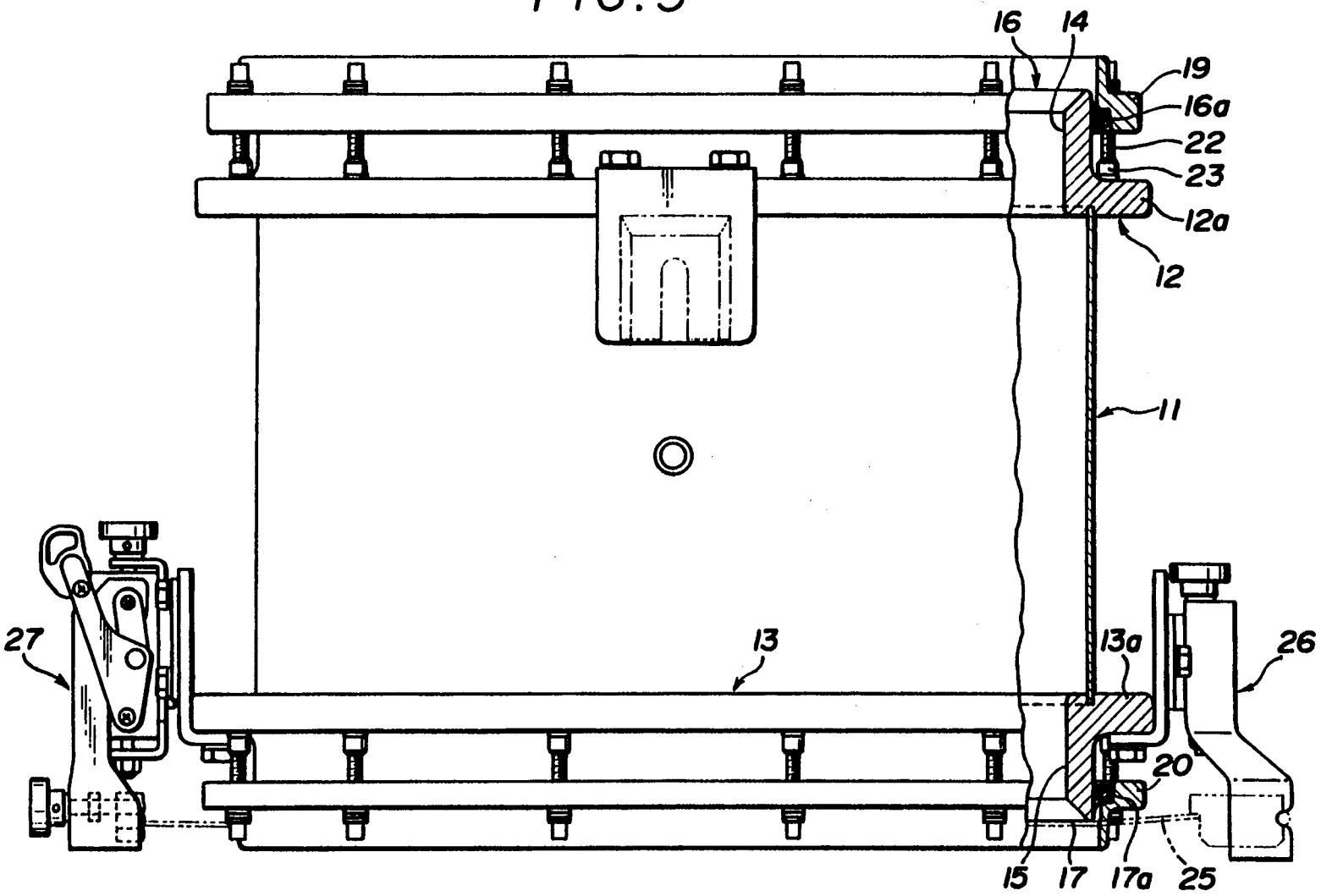
FIG. 3 is a side view, partly in section, of another embodiment of the drum in accordance with the present invention.

Another embodiment of the drum in accordance with the present invention is shown in FIG. 3 in which the constructions involved in high tension fastening of the drum heads are similar to those shown in FIGS. 1 and 2. In the ease of this embodiment, however, connector rods 31 are removed. Thanks to absence of the connector rods 31, the weight of the entire drum is much reduced and, as a consequence, a drum of this type is well suited for marching performance.

In accordance with the present invention, fastening of the drum head causes no axial compression of the kettle which is liable to degrade the acoustic characteristics of the drum. In other words, reaction forces generated by drum head fastening pose substantially no malign influence on the kettle. That is, the reaction forces generated in the screw unit near the upper drum head are born by the counterhoop 19 on the upper side and by the suspension ring 12 on the lower side (see FIG. 2). Since the counterhoop 19 is attached to the suspension ring 12, the reaction force born by the counterhoop 19 acts on the suspension ring 12 downwards and offsets the reaction force borne by the suspension ring 12. Clearly, the kettle 11 is allowed to stay out of any influence by the reaction forces generated by drum head fastening. As a consequence, the drum heads 16 and 17 can be fastened strongly for high tension without any degradation of the acoustic characteristics which would otherwise be caused by unavoidable axial compression of the kettle.

The automatic centering function exhibited by the screw unit well prevents undesirable damage of the screw construction even when the bolt-screw engagement is initially out of strict alignment.

The double-type construction of the screw unit allows independent fastening control on different drum heads.

Acoustic characteristics is much improved thanks to reduction in number of components attached directly to the kettle.

We claim:

1. A drum comprising a tubular kettle open at both longitudinal ends, first and second suspension rings fixed to respective ones of said open ends of said kettle, said first suspension ring having a peripheral extension, a first drum head set in tension to said first suspension ring, the first drum head having a periphery, a first counterhoop in engagement with said periphery of said first drum head, said first counterhoop having a periphery, a first screw unit for fastening said first counterhoop to said first suspension ring, said first screw unit including first lug nuts mounted to said peripheral extension of said first suspension ring, and first fastener bolts each having a first and a second end, each of said first fastener bolts being mounted to the periphery of the first counterhoop near said first end and mounted to a corresponding one of said lug nuts near said second end;

a second drum head set in tension to said second suspension ring, the second drum head having a periphery;

a second counterhoop in engagement with said periphery of said second drum head, said second counterhoop having a periphery; and a second screw unit for fastening said second counterhoop to said second suspension ring, said second screw unit including second lug nuts mounted to a peripheral extension of said second suspension ring, and second fastener bolts each having a first and a second end, each of said second fastener bolts being mounted to the periphery of the second counterhoop near said first end and mounted to a corresponding one of said second lug nuts near said second end.

2. A drum comprising a tubular kettle open at both longitudinal ends, first and second suspension rings fixed to respective ones of said open ends of said kettle, said first suspension ring having a peripheral extension, a drum head set in tension to said first suspension ring, the drum head having a periphery, a counterhoop in engagement with said periphery of said drum head said counterhoop having a periphery, a double-type screw unit for fastening said counterhoop to said first suspension ring, said screw unit including lug nuts mounted to a peripheral extension of said first suspension ring, and fastener bolts each having a first and a second end, each of said fastener bolts being mounted to the periphery of the counterhoop near said first end and mounted to corresponding one of said lug nuts near said second end;

said peripheral extension of said first suspension ring including a plurality of through holes corresponding to said lug nuts, said lug nuts and said through holes having respective diameters and the diameter of each lug nut being smaller than the diameter of its corresponding through hole so that each said lug nut is kept in idle, tiltable engagement with its corresponding through hole to enable automatic centering of the corresponding bolt in said counterhoop.

3. A drum head as claimed in claim 1, further comprising a plurality of connector rods extending in an axial direction of said kettle and having first and second ends, the first ends of said connector rods being connected to the first suspension ring and the second ends of said connector rods being connected to the second suspension ring.

4. A drum as claimed in claim 1 in which said kettle is structured and arranged such that said kettle is in direct contact with said first and second suspension rings only.

* * * * *